US007626066B2

(12) United States Patent
Brown et al.

(10) Patent No.: US 7,626,066 B2
(45) Date of Patent: Dec. 1, 2009

(54) CONVERSION OF UNSATURATED CHEMICALS TO OLIGOMERS

(75) Inventors: Stephen H. Brown, Princeton, NJ (US); Robert A. Crane, Jr., Monroeville, NJ (US); Robert J. Saxton, West Chester, PA (US); William A. Weber, Marlton, NJ (US)

(73) Assignee: ExxonMobil Oil Corporation, Irving, TX (US)

( * ) Notice: Subject to any disclaimer, the term of this patent is extended or adjusted under 35 U.S.C. 154(b) by 64 days.

(21) Appl. No.: 11/716,088

(22) Filed: Mar. 9, 2007

(65) Prior Publication Data

US 2007/0156001 A1 Jul. 5, 2007

Related U.S. Application Data

(63) Continuation of application No. 11/020,427, filed on Dec. 22, 2004, now Pat. No. 7,205,446, which is a continuation of application No. 09/429,295, filed on Oct. 28, 1999, now Pat. No. 6,884,916.

(51) Int. Cl.
*C07C 2/10* (2006.01)

(52) U.S. Cl. ..... 585/530; 585/502; 585/520; 585/531; 585/533

(58) Field of Classification Search ..... 585/530, 585/502, 520, 531, 533
See application file for complete search history.

(56) References Cited

U.S. PATENT DOCUMENTS

| | | | |
|---|---|---|---|
| 2,446,619 | A | 8/1948 | Stewart et al. |
| 2,558,137 | A | 6/1951 | Hepp |
| 2,634,260 | A | 4/1953 | Carnahan |
| 3,113,166 | A | 12/1963 | Weesner |
| 3,692,697 | A | 9/1972 | Kravitz et al. |
| 3,717,586 | A | 2/1973 | Suggitt et al. |
| 3,959,400 | A | 5/1976 | Lucki |
| 3,960,978 | A | 6/1976 | Givens et al. |
| 4,021,502 | A | 5/1977 | Plank et al. |
| 4,081,404 | A | 3/1978 | Wilms et al. |
| 4,098,839 | A | 7/1978 | Wilms et al. |
| 4,112,011 | A | 9/1978 | Kolombos |
| 4,150,062 | A | 4/1979 | Garwood et al. |
| 4,211,640 | A | 7/1980 | Garwood et al. |
| 4,227,992 | A | 10/1980 | Garwood et al. |
| 4,471,147 | A | 9/1984 | Owen et al. |
| 4,504,693 | A | 3/1985 | Tabak et al. |
| 4,547,612 | A | 10/1985 | Tabak |
| 4,628,138 | A | 12/1986 | Barnett et al. |
| 4,665,265 | A | 5/1987 | Chu et al. |
| 4,720,600 | A | 1/1988 | Beech, Jr. et al. |
| 4,795,550 | A | 1/1989 | Sachtler et al. |
| 4,835,331 | A | 5/1989 | Hammershaimb et al. |
| 4,864,067 | A | 9/1989 | Harandi et al. |
| 4,873,385 | A | 10/1989 | Avidan et al. |
| 4,933,068 | A | 6/1990 | Bedard et al. |
| 4,956,514 | A | 9/1990 | Chu |
| 5,000,837 | A | 3/1991 | Harandi |
| 5,034,565 | A | 7/1991 | Harandi et al. |
| 5,113,034 | A | 5/1992 | Soled et al. |
| 5,157,201 | A | 10/1992 | Norris |
| 5,171,905 | A | 12/1992 | Theriot et al. |
| 5,191,139 | A | 3/1993 | Sanderson et al. |
| 5,264,643 | A | 11/1993 | DiGuiseppi et al. |
| 5,557,023 | A | 9/1996 | Somogyvari et al. |
| 5,608,133 | A | 3/1997 | Chang et al. |
| 5,620,590 | A | 4/1997 | Absil et al. |
| 5,792,891 | A | 8/1998 | Adams et al. |
| 5,821,310 | A | 10/1998 | De Boer et al. |
| 5,856,604 | A | 1/1999 | Stine et al. |
| 6,884,916 | B1 | 4/2005 | Brown et al. |

FOREIGN PATENT DOCUMENTS

| | | |
|---|---|---|
| EP | 0 089 795 | 9/1983 |
| EP | 0 734 766 | 10/1996 |
| GB | 614636 | 11/1945 |

OTHER PUBLICATIONS

Kirk-Othmer Encyclopedia of Chemical Technology, 3'd Ed., 14, pp. 477-526.

*Primary Examiner*—Thuan Dinh Dang
(74) *Attorney, Agent, or Firm*—Andrew B. Griffs; Leandro Arechederra, III

(57) ABSTRACT

An oligomerization process in which hydrocarbon feedstocks are contacted with a hydrotreating catalyst in the absence of hydrogen and in the liquid phase. The catalyst is a heterogeneous catalyst selected from supported reduced metals, metals oxides, metal sulfides and combinations thereof. Preferred catalysts include mixed nickel and molybdenum oxides or mixed cobalt and molybdenum oxides. The process also oligomerizes sulfur compounds so that sulfur containing feedstocks can be treated without deactivating the catalysts.

1 Claim, 2 Drawing Sheets

CONVERSION OF UNSATURATED CHEMICALS TO OLIGOMERS

CROSS REFERENCE TO RELATED APPLICATIONS

This application is a continuation of Ser. No. 11/020,427, filed Dec. 22, 2004 now U.S. Pat. No. 7,205,446 which is a continuation of U.S. application Ser. No. 09/429,295, filed Oct. 28, 1999 (now granted as U.S. Pat. No. 6,884,916).

BACKGROUND OF INVENTION

The present invention relates to a process for the oligomerization of hydrocarbon feedstocks using commercial hydrotreating catalysts in the absence of hydrogen. In particular, the present invention relates to a non-hydrogen consuming process for the oligomerization of hydrocarbon feedstocks using hydrotreating catalysts which remain active in the presence of sulfur.

Recent work in the field of olefin upgrading has resulted in a catalytic process for converting lower olefins to heavier hydrocarbons. Particular interest is shown in a technique developed by Garwood, et al., as disclosed in European Patent Application No. 83301391.5, published 29 Sep. 1983, incorporated herein by reference. Distillate range hydrocarbons can be synthesized over ZSM-5 type catalysts at elevated temperature and pressure to provide a product having substantially linear molecular conformations due to the ellipsoidal shape selectivity of certain medium pore catalysts.

Conversion of olefins to gasoline and/or distillate products is disclosed in U.S. Pat. Nos. 3,960,978 and 4,021,502 (Givens, Plank and Rosinski) wherein gaseous olefins in the range of ethylene to pentene, either alone or in admixture with paraffins are converted into an olefinic gasoline blending stock by contacting the olefins with a catalyst bed made up of a ZSM-5 type zeolite. In U.S. Pat. No. 4,227,992, Garwood and Lee disclose the operating conditions for the Mobil Olefin to Gasoline/Distillate (MOGD) process for selective conversion of $C_3^+$ olefins to mainly aliphatic hydrocarbons. U.S. Pat. Nos. 4,150,062 and 4,211,640 (Garwood et al.) disclose a process for converting olefins to gasoline components. In a related manner, dimerization of propene with impregnated $ZrO_2/SO_4$ or $ZrO_2/WO_3$ catalysts is described in U.S. Pat. No. 5,113,034.

In the process for catalytic conversion of olefins to heavier hydrocarbons by catalytic oligomerization using a medium pore shape selective acid crystalline zeolite, such as ZSM-5 type catalyst, process conditions can be varied to favor the formation of hydrocarbons of varying molecular weight. At moderate temperature and relatively high pressure, the conversion conditions favor $C_{10}^+$ aliphatic product. Lower olefinic feedstocks containing $C_2$-$C_8$ alkenes may be converted; however, the distillate mode conditions do not convert a major fraction of ethylene. A typical reactive feedstock consists essentially of $C_3$-$C_6$ mono-olefins, with varying amounts of nonreactive paraffins and the like being acceptable components.

The improvement of the performance of natural mineral oil based lubricants by the synthesis of oligomeric hydrocarbon fluids has been the subject of extensive research and development in the petroleum industry for many years. This research has led to the introduction of a number of superior polyalpha-olefin (PAO) synthetic lubricants produced by the oligomerization of alpha-olefins or 1-alkenes. In terms of lubricant property improvement, the industrial research effort for synthetic lubricants has been toward fluids exhibiting useful viscosities over a wider range of temperature, i.e., improved viscosity index (VI), while also showing lubricity, thermal and oxidative stability and pour point equal to or better than mineral oil. These new synthetic lubricants exhibit lower friction characteristics and are, therefore, capable of increasing mechanical efficiency of various types of equipment including engines, transmissions, worm gears and traction drives, over a broader range of operating conditions than mineral oil lubricants.

PAO lubricants are often formulated with additives to enhance those properties for specific applications. Among the more commonly used additives are oxidation inhibitors, rust inhibitors, metal passivators, antiwear agents, extreme pressure additives, pour point depressants, detergent-dispersants, viscosity index (VI) improvers, foam inhibitors and the like. This aspect of lubricant technology is described in Kirk-Othmer Encyclopedia of Chemical Technology, 3rd ed., 14, 477-526, to which reference is made for a description of the use of such additives.

PAOs useful as synthetic base stocks or functional fluids may be synthesized by homogeneous catalysts, such as promoted $BF_3$ or $AlCl_3$ catalysts. The synthesis of PAOs with a promoted BF catalyst is discussed in the Theriot et al. U.S. Pat. No. 5,171,905. The PAO processes using homogeneous catalysts always include a complicated and tedious catalyst separation step. For example, the promoted $BF_3$ or $AlCl_3$ catalyst is usually deactivated and destroyed by washing with sodium hydroxide, dilute acid and water consecutively.

One of the problems with commercial catalytic oligomerization processes presently being used is the rapid deactivation of the catalysts in the presence of even low levels of nitrogen and sulfur in the feed stream. Therefore, there is a need for a catalytic hydrotreating process which can oligomerize chemicals in nitrogen and sulfur contaminated feed streams without a substantial reduction in the reactivity of the catalyst.

SUMMARY OF THE INVENTION

In accordance with the present invention, an oligomerization process is provided. The process includes contacting a hydrocarbon feedstock with a catalyst, preferably a hydrotreating catalyst, in the absence of hydrogen. When the process is used for hydrocarbon feedstocks that contain sulfur-containing molecules, the sulfur-containing molecules are also oligomerized. The oligomerizalion of the sulfur compounds prevents the formation of $H_2S$ in the reactor, which deactivates the catalyst. A preferred hydrotreating catalyst includes non-acidic supported mixed metal oxides. In another embodiment, the hydrotreating catalyst is supported on alumina and includes mixed nickel and molybdenum oxides or mixed cobalt and molybdenum oxides. A particularly preferred hydrotreating catalyst is a $NiMo/Al_2O_3$ catalyst. The catalyst can also be a heterogeneous catalyst selected from the group consisting of supported reduced metals, metals oxides, metal sulfides and combinations thereof.

The process is carried out a temperature of from about 200° F. to about 500° F.; a space velocity of from about 0.1 WHSV to about 100 WHSV; and a pressure of from about 50 psig to about 1000 psig. In a preferred embodiment, the process is carried out at a temperature of from about 250° F. to about 450° F.; a space velocity of from about 0.1 WHSV to about 3 WHSV; and a pressure ranging from about 100 psig to about 500 psig. The process is preferably carried out in the liquid phase.

The process of the present invention decreases operating costs by eliminating the need for hydrogen in the oligomerization reaction and allows sulfur containing feedstocks to be processed without preliminary desulfurization or frequent replacement of the catalyst.

BRIEF DESCRIPTION OF THE FIGURES

Other advantages and attendant features of this invention will be readily appreciated as the invention becomes better understood by reference to the following detailed description when considered in connection with the accompanying drawings wherein.

DETAILED DESCRIPTION OF THE INVENTION

Figure 1:
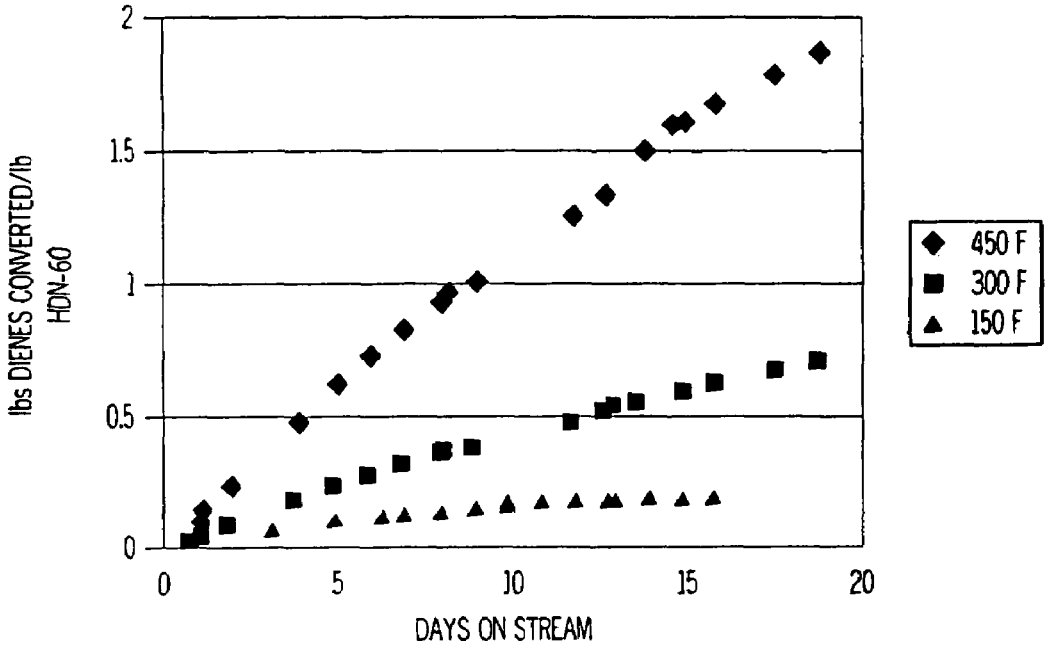
FIG. 1 is an graph showing the diene conversion rate over time.

The present invention provides a process for oligomerizing hydrocarbon feedstocks using hydrotreating catalysts in the absence of hydrogen. Commercial hydrotreating catalysts typically include supported metal oxides when they are received from the manufacturers. When sulfur is present in the feedstock, there is a strong thermodynamic and kinetic drive to transform the supported metal oxide to metal sulfide. The catalysts used in the present invention remain active in the presence of sulfur by oligomerizing the sulfur molecules in the feedstock. This enables untreated refinery streams to be used as a feedstock without preliminary desulfurization.

The present invention uses a hydrotreating catalyst in the absence of hydrogen to convert hydrocarbons to oligomers without significant catalyst aging. The hydrotreating catalyst preferably has good hydrogen transfer and minimal cracking characteristics and a metal component, such as nickel, cobalt, chromium, vanadium, molybdenum, tungsten, or a combination thereof. However, a wide variety, of supported reduced metals, metal oxides and/or metal sulfides (alone or in combination) can be used for oligomerization reactions between 300° and 600° F. in the liquid phase.

Conventional catalytic hydrotreating processes use a hydrotreating catalyst in the presence of hydrogen to saturate hydrocarbons and convert the sulfur containing molecules to low value paraffins and $H_2S$. The process of the present invention upgrades olefins and sulfur containing molecules to oligomers, instead of converting them to paraffins and $H_2S$.

The conversion of both thiophene and olefin in a single reactor allows the oligomerization of chemicals present in sulfur contaminated streams such as light FCC gasoline. Many oligomerization catalysts such as Ziegler Natta catalysts or zeolite catalysts are known to undergo rapid deactivation in the presence of even low levels (10-100 ppm) of sulfur. Test runs using thiophene containing feedstocks show that the metal oxides are likely to be converted to metal sulfides. It has also been found that for many of the feedstocks, including the reformate applications, the sulfided catalyst has superior activity, selectivity, and stability. Accordingly, for these feedstocks, it is advantageous to presulfide the catalyst before use.

The reactivity of thiophene suggests that many functionalized chemicals will be reactive when contacted with hydrotreating type catalysts in the absence of hydrogen. For example, any chemical containing double bonds, oxygen, nitrogen, sulfur or any combination of these functional groups. The reactivity to oligomers is due to the operating conditions, i.e., 400° to 500° F. in the liquid phase, which are more severe than typical conditions used to conduct oligomenrzations/polymerizations, normally 50° to 200° F. in the liquid or gas phase.

The present invention uses supported metal oxides or sulfides as catalysts and has a variety of applications. For instance, this non-hydrogen consuming process can be used for the selective removal of dienes and sulfur-containing compounds from $C_4$ and $C_5$ olefin streams. Another potential application is the removal of sulfur from fuel streams by the oligomerization of the sulfur-containing molecules using hydrotreating catalysts in the absence of hydrogen. The oligomerization of the sulfur-containing molecules has a high speed of reaction so that the sulfur oligomerization is substantially completed before the hydrocarbon molecules are significantly oligomerized. This allows one embodiment of the present invention to be limited to the oligomerization of the sulfur molecules and another embodiment to convert the sulfur molecules simultaneously with some or all of the other reactive molecules in the feed stream. Downstream distillation of the oligomerized stream provides a heave stream with concentrated sulfur and a lighter, desulfurized stream.

In another embodiment, a swing-bed process is used to remove sulfur from a hydrocarbon feedstock. The sulfur in the feedstock stoichiometrically converts the supported metal oxides of a commercial hydrotreating catalyst to metal sulfides in a first reactor. When the reaction is complete and the catalyst is fully loaded with sulfur, the hydrocarbon feedstream is switched to the second reactor bed. The catalyst in the off-stream bed is then returned to the initial metal oxide by air regeneration.

A preferred embodiment of the present invention selectively removes dienes from FCC, pygas and coker-derived feedstreams. Currently dienes are removed from these streams using conventional hydrotreating processes which consume large amounts of hydrogen. The present invention uses a hydrogen-free process to form diene oligomers which are subsequently removed from the reactor effluent.

Hydrotreating catalyst can also remove olefins, sulfur, and nitrogen compounds from FCC, coker, and pygas streams. Downstream distillation produces a wide variety of product streams with unique properties. At least several of these unique streams are likely to find a profitable use as "special products" or specialty chemicals, such as solvents, coatings, pigments, extenders, drilling muds, co-monomers, elastomers, feedstocks (such as carbon black, anode grade coke, carbon fibers) etc.

When an aromatics reformate-derived feedstock is used, the diene contaminants in the feedstock are substantially converted to oligomers upon contact with the hydrotreating catalyst. At the same time and to a lesser extent, olefins are converted to alkylaromatics. The 650+ cut from the oligomerization of the hydrocarbons in refiner, streams are largely aliphatic (low aromatics) and, therefore, provide a low-cost lube base stock. For some feedstocks, additional hydrotreating may be necessary to remove any remaining olefinic character, tailor the sulfur content or remove wax.

The present invention is intended to cover the oligomerization of any unsaturated chemical (including chemicals containing carbon-carbon double or triple bonds, nitrogen, sulfur, oxygen or any combination thereof) using either a commercial hydrotreating or heterogeneous catalysts selected from the group consisting of supported reduced metals, metal oxides, metal sulfides and combinations thereof. In addition to refinery processes, there are numerous feedstocks in the chemical industry that have a variety of types of unsaturated hydrocarbons that can be oligomerized using the process of the present invention. For example, pulp and paper byproducts, sugars, natural fatty acids and alcohols.

Hydrotreating Catalyst System

The aromatics reformate-derived stream is initially contacted with a hydrotreating catalyst to substantially convert all dienes to oligomers. The hydrotreating catalyst has a metal component which can be a single metal from Groups VIA and VIIIA of the Periodic Table, such as nickel, cobalt, chromium, vanadium, molybdenum, tungsten, or a combination of two or more of these metals, such as nickel-molybdenum, cobalt-nickel-molybdenum, cobalt-molybdenum, nickel-tungsten or nickel-tungsten-titanium. Generally, the metal component is selected for good hydrogen transfer activity and the catalyst as a whole should have good hydrogen transfer and minimal cracking characteristics. A preferred hydrotreating catalyst is a commercial $NiMo/Al_2O_3$ catalyst, such as HDN-60, manufactured by American Cyanamid. The catalyst is used as it is received from the manufacturer, i.e., in its oxide form. The support for the catalyst is conventionally a porous solid, usually alumina, or silica-alumina but other porous solids such as magnesia, titania or silica, either alone or mixed with alumina or silica-alumina may also be used, as convenient. Zeolites are preferred for the catalyst support.

Process Conditions

In general, the method for the removal of mono-olefins is carried out in a fixed bed reactor under conditions including a moderately elevated temperature ranging from about 200° to about 500° F., preferably from about 250° F. to about 450° F.; a space velocity ranging from about 0.1 WHSV (weight hourly space velocity) to about 100 WHSV, preferably from about 0.1 WHSV to about 3 WHSV; and a pressure ranging from about 50 psig to about 1000 psig, preferably about 100 psig to about 500 psig.

The feedstocks used for testing the process of the present invention were a $C_7^-$ reformate containing 0.45 wt % olefins; a $C_7^-$ reformate containing 0.30 wt % olefins; a light reformate containing a mixed benzene+toluene stream.

Autoclave reactions were also preformed. Toluene, heptane, thiophene, and 1-octene were obtained from Aldrich Chemical Company of Milwaukee, Wis. and used as received.

EXAMPLES

The tests in Examples 1 through 4 were conducted at the following conditions: 100-240° C. and 100-300 psig. The pressure was chosen to ensure 100% liquid-phase conditions. The heavy reformate has a bubble point of about 420° F. at 100 psig and the aromatic extract has a bubble point of 460° F. at 300 psig. No gases are fed or produced at these conditions, making off-line gas chromatographic ("GC") analysis convenient. A Hewlett Packard HP 5890 gas chromatograph equipped with a 30-meter DB-1 capillary column was used for the analysis. The olefins and dienes in the feedstock and product were present at only ppm levels. Nonetheless, a number of these trace components can be clearly observed with baseline resolution. The following temperature program was used: 0° C. for 30 minutes. ramp at 15° C./minute to 230° C. hold at 230° C. for 30 minutes. The largest baseline resolved olefin eluted near 2450 seconds using this program. The conversion of this peak was monitored vs. time on stream in order to judge catalyst stability when heavy reformates were being studied. No dienes were observable in this feed by GC analysis. The 20-40 ppm dienes in these feeds apparently are all hidden beneath co-boiling hydrocarbons.

The Bromine Index is a method of calculating the contents of an olefin and is used herein as a means of comparing the test results. Undesirable hydrocarbon contaminants containing olefinic bonds are quantified by the Bromine Index (BI). The number of grams of bromine absorbed by 100 grams of a hydrocarbon indicates the percentage of double bonds present. Thus, when the type and molecular weight is known, the contents of the olefin can be calculated. The Bromine Indices (i.e., numbers) of the hydrocarbon feeds and products are measured to determine the change in composition.

The following non-limiting examples illustrate the invention:

Example 1

In this example, the feedstock was a $C_7^-$ cut of full-range cyclic catalytic reformer ("CCR") reformate containing 47 wt % toluene, 43 wt % $C_8$ aromatics, 9 wt % $C_9^-$ aromatics, and 0.25 wt % olefins. No dienes were detected in this feed using standard GC analysis. This feedstock was processed at 1 WHSV over HDN-60 at 464° F. and 200 psig 90% olefin conversion was observed. After two days on stream, olefin conversion activity still remained above 85%, indicating sufficient stability to achieve monthly cycles in a swing-bed operation by judicious choice of WHSV.

Example 2

For this example, a light aromatics extract containing 65 wt % benzene and 33 wt % toluene was used as the feedstock. This feedstock had a BI of about 160 and contained about 80 ppm of cyclopentadiene, 160 ppm of mixed methylcyclopentadiene, and 250 ppm of olefins. The feedstock was contacted with the HDN-60 catalyst at 16 WHSV, 392° F. and 200 psig. The fresh catalyst converted 66% of the methylcyclopentadiene to oligomers at the start of the run. After two weeks on stream, the conversion dropped in half to 33% indicating an aging rate of 12.5° F./week at 16 WHSV. A review of all the olefin peaks indicated that out of 20-odd resolved olefin peaks only two underwent measurable conversions of <20%. Based on the much higher reactivity of dienes vs. olefins, the hydrotreating catalyst showed excellent selectivity for diene vs. olefin conversion. By adjusting the WHSV to achieve maximum diene conversion based on the composition of the feedstock, HDN-60 can be used for fixed-bed conversion of dienes to oligomers with cycle lengths exceeding one year.

Example 3

A feedstock comprising 1 wt % thiophene, 10 wt % 1-octene, 44 wt % heptane, and 55 wt % toluene was used for this example. A commercial hydrotreating catalyst (HDN-60 NiMo oxide/alumina, precalcined in air at 400° C.) in the ratio of 0.1 gm of catalyst for each 1 gm of feedstock was added to an autoclave in nitrogen which was filled half full. The autoclave was sealed and brought to 400° F. for 20 hours. The autoclave was cooled and opened. No significant amount of gases were produced. The liquid product was analyzed by GC and showed that more than 95% of both the thiophene and octene had been converted to oligomers.

Example 4

A feedstock comprising 1 wt % thiophene, 10 wt % 1-octene, 44 wt % heptane, and 55 wt % toluene was used for this example. A commercial hydrotreating catalyst (KF-752 obtained from Akzo Chemicals, a CoMo (cobalt-molybdenum) oxide/alumina precalcined in air at 400° C.) in the amount of 0.1 gm of catalyst for each 1 gm of feedstock was added to an autoclave in nitrogen which was filled half full. The autoclave was sealed and brought to 400° F. for 20 hours. The autoclave was cooled and opened. No significant amount of gases were produced. The liquid product was analyzed by GC and showed that more than 95% of both the thiophene and octene had been converted to oligomers.

Example 5

In this example, HDN-60 sized to 60/200 mesh was evaluated for activity and stability at 18 WHSV and 150° F., 18 WHSV and 300° F., and 48 WHSV and 450° F. using a light aromatics extract containing 65 wt % benzene and 33 wt % toluene. The feed had a Bromine Index (BI) of about 80 and contained <10 ppm of cyclopentadiene, 110 ppm of mixed methylcyclopentadienes and 125 ppm of olefins. Total pounds of dienes converted per pound of catalyst was plotted versus time on stream for each run is shown in FIG. 1. Plots of conversion versus lime are typically linear for a stable catalyst, but gradually bend and become horizontal when the catalyst is completely deactivated. The results in FIG. 1 show that the catalyst aged gradually for each run. Total diene capacity for the catalysts was calculated by extrapolating the curves until they became horizontal. Using this method, obtained total diene removal capacities measured in pound diene per pound catalyst per cycle of 0.25 at 150° F., at 300° F. and 3.0 at 450° F. FIG. 1 shows that diene removal capacity continues to rise as the temperature increases, and that optimum performance will occur at or near the maximum operating temperature for the unit.

Example 6

Figure 2:
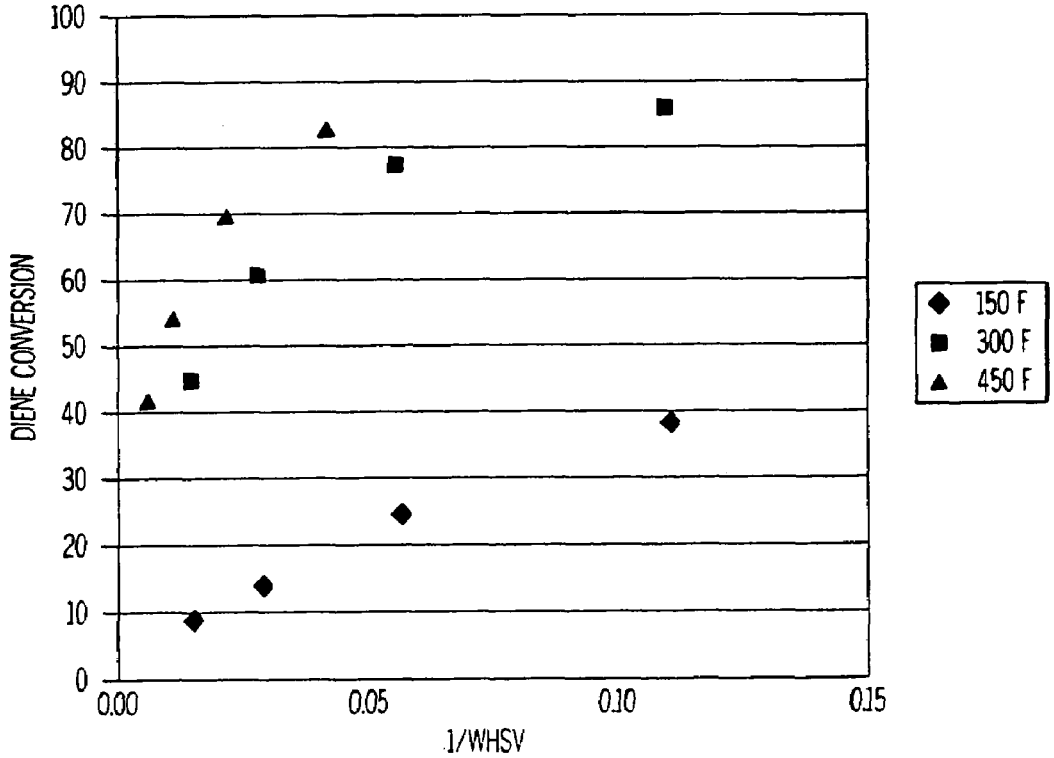
FIG. 2 is a graph comparing the diene conversion rate at different temperatures and contact times.

During each of the aging runs in Example 5, diene conversion was recorded as a function of feedstock WHSV. Decreasing the temperature from 450° F. to 300° F. was compensated for by doubling the feedstock contact time in order to maintain approximately the same conversion rate. Decreasing the temperature by another 150° F. (i.e., from 300° F. to 150° F.) required a ten fold increase in feedstock contact time to maintain the diene conversion rate. The results of these tests are plotted in FIG. 2, which shows that at operating temperatures above 300° F., diene conversion activity is not a strong function of temperature.

Example 7

Figure 3:
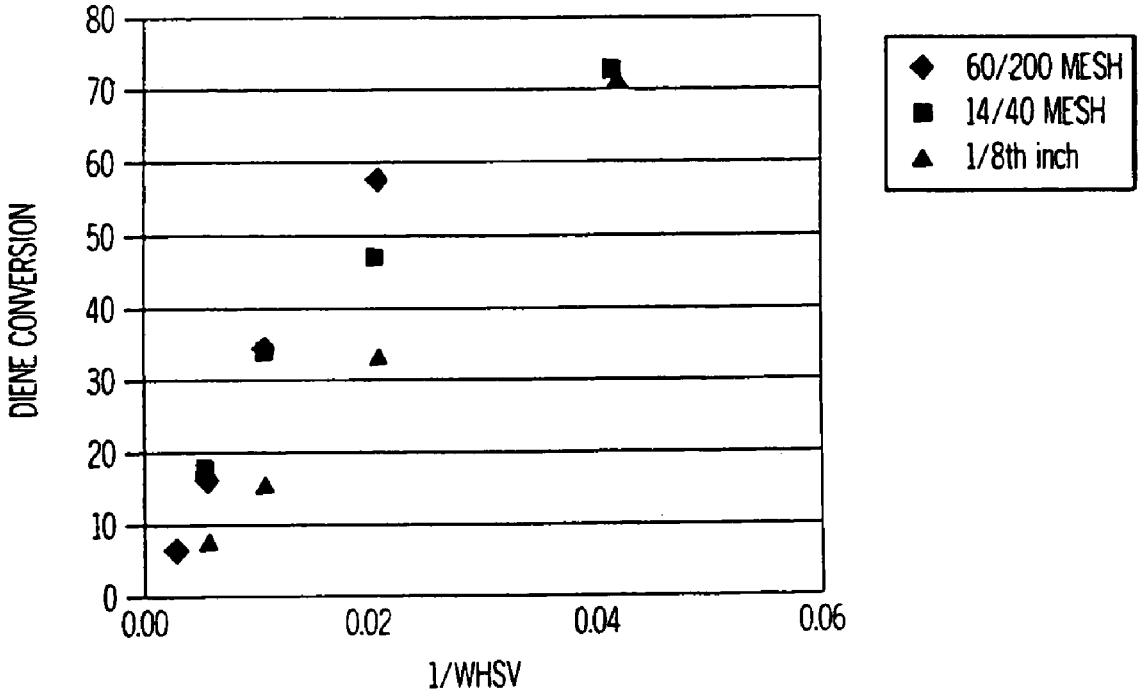
FIG. 3 is a graph showing the conversion rates of different particle size catalysts.

For this example, three runs were carried out, using the same light aromatics extract used in Example 5, at 300° F. and 300 psig with three catalyst charges of HDN-60, each having a different particle size, 60/200 mesh, 14/40 mesh and ⅛th inch extrudate. For each run, a wide range of conversions was obtained by varying WHSV. FIG. 3 is a plot of diene conversion versus contact time and these results show that the particle size of the catalyst does not significantly affect the conversion rate and that diene conversion is not macropore diffusion limited.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A process for upgrading olefins and sulfur containing molecules to oligomers comprising contacting an aromatics reformate-derived feedstream containing olefins and sulfur containing molecules with a hydrotreating catalyst selected from the group consisting of reduced metals, metal oxides, metal sulfides, and mixtures thereof, in the absence of hydrogen and in the liquid phase at a temperature of between 200° C. and 500° C. and upgrading said olefins and sulfur containing molecules to oligomers, wherein dienes in said feedstream are converted to oligomers and olefins in said feedstream are converted to alkylaromatics.

* * * * *